US005727632A

United States Patent [19]

Richards

[11] Patent Number: 5,727,632

[45] Date of Patent: Mar. 17, 1998

[54] TOP RELEASE RETRIEVABLE BRIDGE PLUG OR PACKER AND METHOD OF RELEASING AND RETRIEVING

[75] Inventor: William Mark Richards, Houston, Tex.

[73] Assignee: Baker Hughes Incorporated, Houston, Tex.

[21] Appl. No.: 622,546

[22] Filed: Mar. 25, 1996

[51] Int. Cl.[6] ..... E21B 23/06

[52] U.S. Cl. ..... 166/387; 166/123; 166/134

[58] Field of Search ..... 166/118, 123, 166/134, 135, 181, 182, 389

[56] References Cited

U.S. PATENT DOCUMENTS

| | | | |
|---|---|---|---|
| 2,776,012 | 1/1957 | Baker | 166/123 |
| 4,059,150 | 11/1977 | Manderscheid | 166/120 |
| 4,436,150 | 3/1984 | Barker | 166/131 |
| 4,457,369 | 7/1984 | Henderson | 166/125 |
| 4,565,247 | 1/1986 | Tapp et al. | 166/387 X |
| 4,572,289 | 2/1986 | Rosenthal | 166/123 |
| 4,898,239 | 2/1990 | Rosenthal | 166/133 |
| 4,898,245 | 2/1990 | Braddick | 166/387 |
| 5,366,010 | 11/1994 | Zwart | 166/120 |
| 5,441,111 | 8/1995 | Whiteford | 166/387 |

OTHER PUBLICATIONS

Petroleum Oil Tools, literature on "WRP" Bridge Plug, Wireline Pulling Tool, WRP Bridge Plug Pulling Tool Collet Type, WRP Auto–J Pulling Tool, G Valve, BP Valve, 12 pages (undated).

Baker Oil Tools, Product Report, Model "WG" Bridge Plug, Nov. 1994, 1 page.

Arrow Completion Systems, Enterra Service Tools, literature on HE and HE2 Wireline Set Retrievable Bridge Plug WBP, WB2, Retrieving Tools, 3 pages.

Baker Service Tools, literature on Model "B" Lok–Set Retrievable Bridge Plug and Model L Retrieving Head, Dec. 1976, 3 pages.

Baker Service Tools, literature on Baker Wireline Set Retrievable Bridge Plug, Mod. "M" Washover Type Retrieving Head, Wireline Adapter Kit, Nov., 1984, 5 pages.

Halliburton, literature on Model 3 or 3L Packer Type Retrievable Bridge Plug, 3 pages, 1983, 1987.

*Primary Examiner*—David J. Bagnell

*Attorney, Agent, or Firm*—Rosenblatt & Redano, P.C.

[57] ABSTRACT

A packer or bridge plug design is revealed that has a lock mechanism involving the interengagement of teeth. The meshing of the teeth holds the set of the sealing elements and slips of the packer or bridge plug. Release is accomplished by an application of weight which, due to relative movement of parts, allows the stress applied to the slips and sealing element to be relieved with the interengaging teeth of the lock mechanism still in place. Upon stress relief as to the slips and sealing elements, further movement cams the locking member in a manner so as to separate the interengagement of the teeth, thus completing the release. The stress-relief mechanism and the lock mechanism are part of a compact assembly which is preferably mounted above the packer or bridge plug for easy access. A pressure equalization technique involves discrete operation of an equalizing sleeve followed by at least one opposed motion before a release sleeve can be tagged for removing the plug.

32 Claims, 10 Drawing Sheets

TOP RELEASE RETRIEVABLE BRIDGE PLUG OR PACKER AND METHOD OF RELEASING AND RETRIEVING

FIELD OF THE INVENTION

The field of this invention relates to downhole tools which are releasable from above, particularly tools that can selectively obstruct a wellbore, such as a packer or a bridge plug, but the invention can be applied to other tools such as liner hangers.

BACKGROUND OF THE INVENTION

Prior designs of packers and bridge plugs generally incorporate a feature in which the sealing element is compressed and the compressed state is retained by some locking mechanism. Generally, in most designs of the prior art, the set of the sealing elements is retained by a locking mechanism and the packer or bridge plug is released subsequently by relieving the compressive force acting on the sealing member or members at a location different and discrete from the lock mechanism which retains the compressive force. Thus, prior techniques have involved the actuation of pistons or the breaking of shear pins remotely located from the primary locking member to relieve the stress on the locking member before retrieving the packer or bridge plug. Generally, these pistons or shear pins which relieve the stress on the main locking member were located below the packer or bridge plug. Typical of some of the designs of bridge plugs or packers of the prior art are U.S. Pat. Nos. 5,441,111; 5,366,010; 4,457,369; 4,436,150; 4,059,150; and 2,776,012. U.S. Pat. No. 4,898,245 illustrates a bridge plug involving an external release means adjacent its upper external end, which includes the use of a grapple-engaging surface to release the bridge plug without engaging the packer element or slip elements which secure the packer arrangement in the tubular member and without inserting any mechanism in the set packer arrangement.

The common feature of the designs of the past required an extremely long design if the release mechanism was set below the packer. Additionally, the use of a separate locking mechanism and a distinguishable release mechanism also added length and complication to the tool.

The apparatus of the present invention attempts to address some of these issues to allow the resulting construction of a tool, such as a bridge plug, to give the operator a device to maintain a downhole differential pressure during service operations in the well or to set flow-control devices in tubing without the use of nipple profiles.

The object of the invention is to provide a mechanically reliable locking assembly which, in a compact design, also features stress-relief of the locking assembly prior to release of the lock. The invention accomplishes this and other objectives by arrangement of parts so that it predetermines the sequence of motions to occur which achieve the desired result of stress relief from the lock prior to biasing the lock member into an unlocked position after seal members have been relaxed. The beneficial results from the arrangement being placed on top and being compact and simple are that the locking mechanism becomes more reliable for longer service because it is released with the stress on the lock removed.

Prior designs that have attempted to deal with this issue have either opted for unlocking devices remotely located from the lock and generally located below the packer or bridge plug, adding yet further complications to the release procedure. Thus, another object of the invention is to allow for reliable unlocking without damage to the locking mechanism and to accomplish such unlocking by one continuous unidirectional movement.

SUMMARY OF THE INVENTION

A packer or bridge plug design is revealed that has a lock mechanism involving the interengagement of teeth. The meshing of the teeth holds the set of the sealing elements and slips of the packer or bridge plug. Release is accomplished by an application of weight which, due to relative movement of parts, allows the stress applied to the slips and sealing element to be relieved with the interengaging teeth of the lock mechanism still in place. Upon stress relief as to the slips and sealing elements, further movement cams the locking member in a manner so as to separate the interengagement of the teeth, thus completing the release. The stress-relief mechanism and the lock mechanism are part of a compact assembly which is preferably mounted above the packer or bridge plug for easy access. A pressure equalization technique involves discrete operation of an equalizing sleeve followed by at least one opposed motion before a release sleeve can be tagged for removing the plug.

DETAILED DESCRIPTION OF THE DRAWINGS

FIGS. 1*a*–1*d* illustrate the run-in position.

FIGS. 2*a*–2*d* illustrate some movement of the setting mechanism toward setting the packer or bridge plug.

FIGS. 3*a*–3*d* illustrate the position of the tool at the conclusion of equalizing prior to release.

FIGS. 4*a*–4*d* illustrate the initial movement toward the release.

FIGS. 5*a*–5*d* show further movement illustrating the release of the compressive force on the sealing members.

FIGS. 6*a*–6*d* show the sealing members completely relaxed and the onset of movement of the dogs.

FIGS. 7*a*–7*d* illustrate retraction of the slips to permit the packer or bridge plug to be removed from the wellbore.

FIG. 8 is a sectional elevational view of the release mandrel, illustrating the windows wherein the locking dogs reside.

FIG. 8*a* is a top view of the release mandrel shown in FIG. 8.

DETAILED DESCRIPTION OF THE PREFERRED EMBODIMENT

Figure 1A:
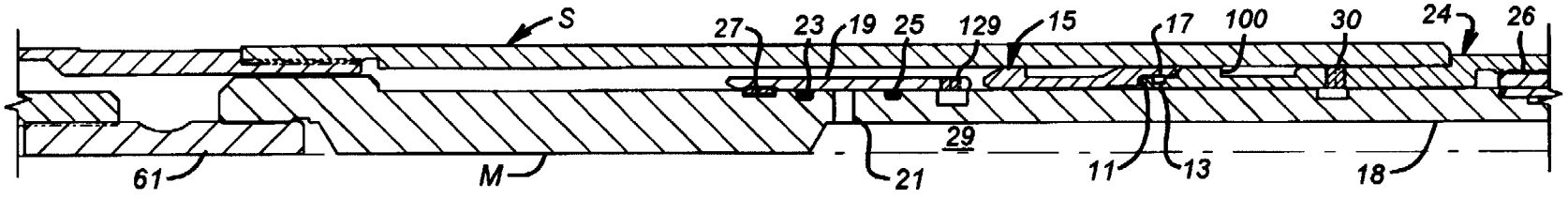

Referring now to FIGS. 1*a*–1*d*, the run-in position is disclosed. FIG. 1 illustrates a bridge plug B, which generally has a mandrel M extending into a portion of the assembly, not all of which is illustrated in FIGS. 1*a*–1*d*. In general, the mandrel is an assembly of parts that begins at bottom sub 12 which is connected to a body 14 at thread 16. The body 14 is connected to cylindrically shaped member 18 as illustrated in FIG. 1*a*. Ultimately, a standard wireline setting tool (not shown) is connected to member 18 to retain the mandrel assembly M, while a setting sleeve on such known setting tools bears down on actuation sleeve 24. Actuation sleeve 24 is engaged at thread 26 to release mandrel 28. Release mandrel 28 is shown in greater detail in FIG. 8. During the run-in position, the actuation sleeve 24 is secured to sleeve 18 by a shear pin 30.

Figure 1B:
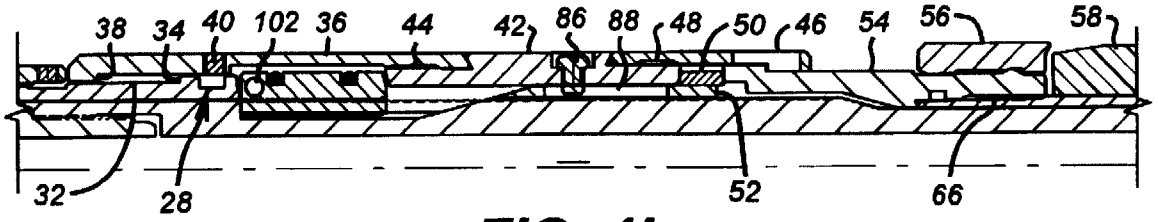
Figure 2B:
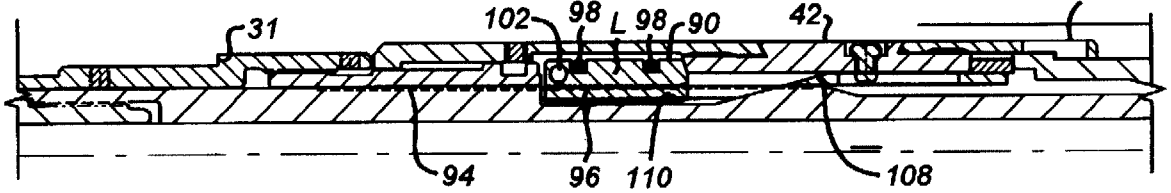
Figure 3B:
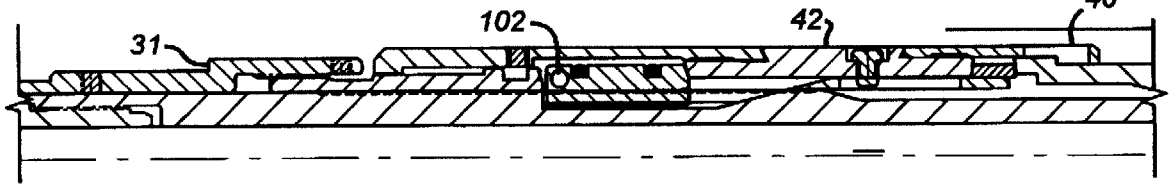
Figure 1C:
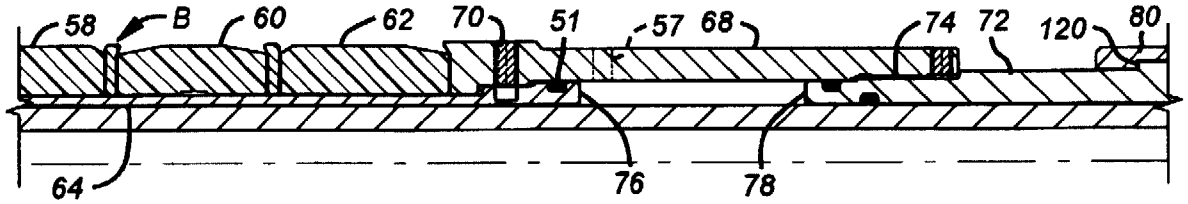
Figure 2C:
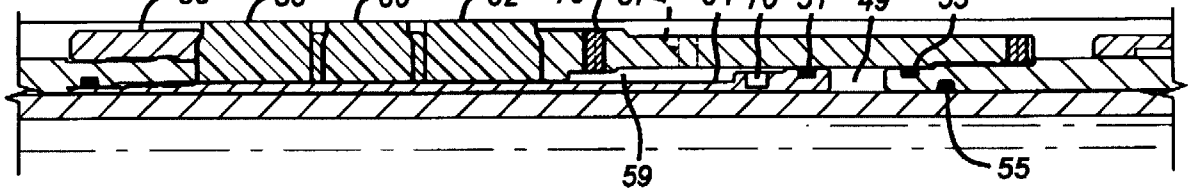
Figure 3C:
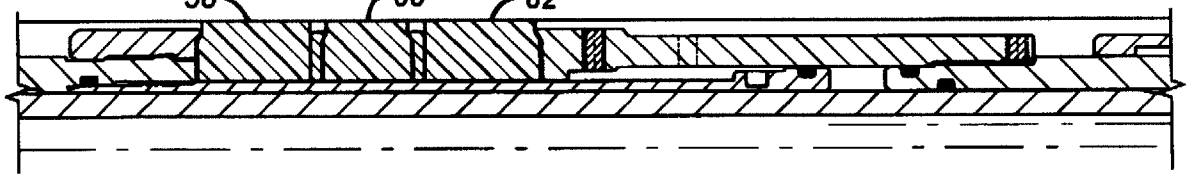
Figure 4C:
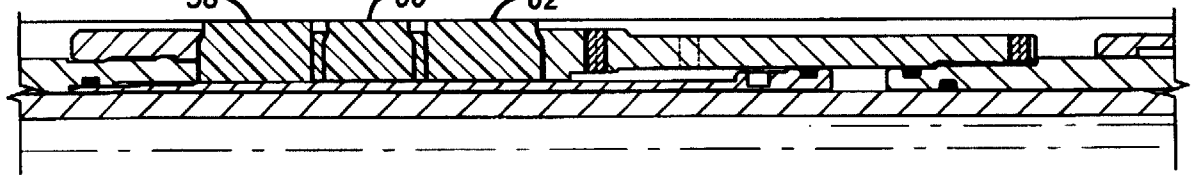
Figure 1D:
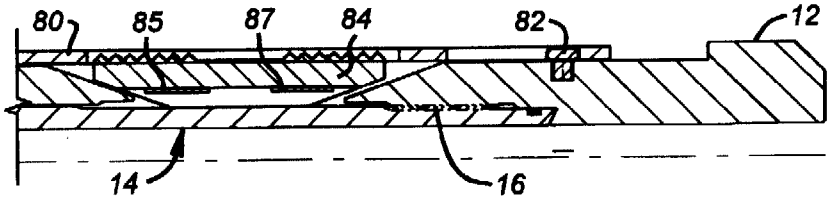
Figure 5B:
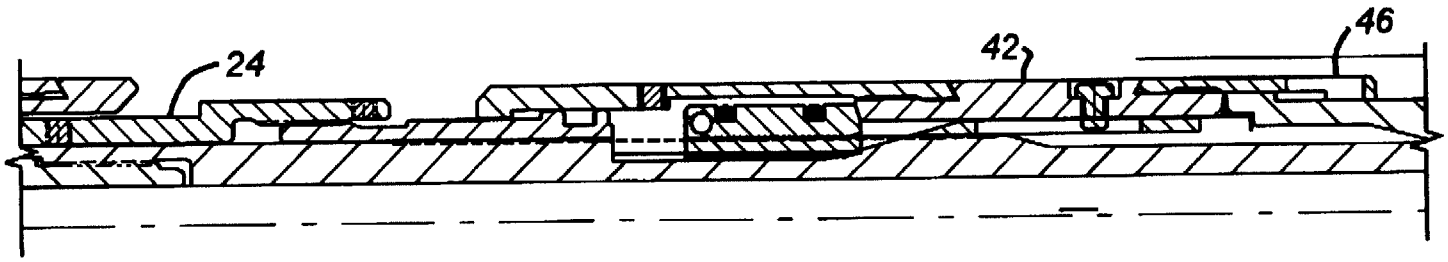

The release mandrel 28 has a recessed surface 32 which defines a shoulder 34. The upper end of sleeve 36 has an internal shoulder 38 opposed to shoulder 34, but at a distance from shoulder 34 during run-in, as shown in FIG. 1*b*. Shear pin 40 secures the sleeve 36 to release mandrel 28 during run-in. Sleeve 36 is also connected to ring 42 at thread 44. Ring 42 is connected to lower sleeve 46 at thread 48. In the run-in position, the lower sleeve 46 circumscribes release ring 50. Release ring 50 is preferably made of a spring steel-type material and has a C-shape when viewed in section in a plane perpendicular to the view of FIG. 1*b*. Ring 50 can also have a variety of other shapes, including ring segments, or can be made of a flexible material that can still carry a compressive load. The C-ring may also have various cutouts along its length to affect its structural strength so that it will collapse when required more readily, as will be described below. In the view shown in FIG. 1*b*, release or split ring 50 is in an expanded position radially such that it is storing a force wanting to make it move radially inwardly should the support of the lower end 52 of release mandrel 28 be moved out of the way, as shown in FIG. 5*b*. However, in the run-in position, the ring 42 bears directly on release ring 50, which in turn bears directly on ring 54. Ring 54 is connected to ring 56 which bears on the sealing elements 58, 60 and 62. Ring 54 is also connected to sleeve 64 which supports the sealing elements 58, 60 and 62. Sleeve 64 is connected to ring 54 at thread 66. In the run-in position, the sleeve 64 is secured to ring 68 by shear pin 70 (FIG. 1*c*). Ring 68 is secured to cone 72 at thread 74. A gap exists between the lower end 76 of sleeve 64 and the upper end 78 of cone 72 to allow for compression of the sealing elements 58, 60 and 62, as will be described below. Pin 82 is in a slot cut into retainer 80 to prevent rotation. Thus, during run-in, retainer 80 holds back slips 84 against springs 85 and 87, as shown in FIGS. 1*c* and 1*d*.

Figure 8A:
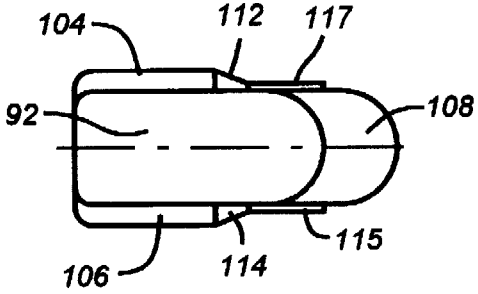
Figure 8:
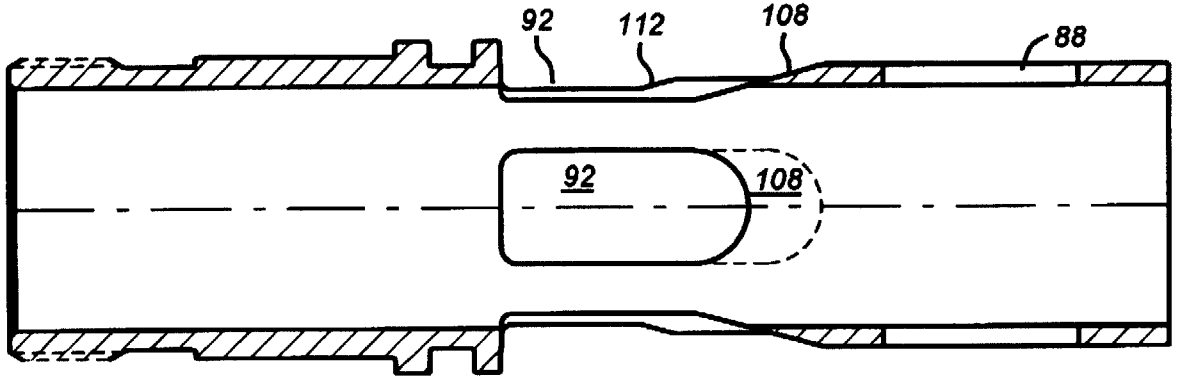

A pin 86 (see FIG. 1*b*) extends through ring 42 and into a window 88 in release mandrel 28 (see also FIG. 8). The pin 86 is essentially a rotational lock with respect to release mandrel 28 so that the assembly, which includes ring 42 and those components attached to it, cannot rotate with respect to release mandrel 28, but can move longitudinally, as can be seen by comparing FIG. 1*b* to FIG. 5 or 6*b*.

The sleeve 24 has an upper end 11 which has a groove 13. Equalizing sleeve 15 has a tab 17 which extends into groove 13. The strength of shear pin 30 exceeds the strength of tab 17 in groove 13.

Figure 3A:
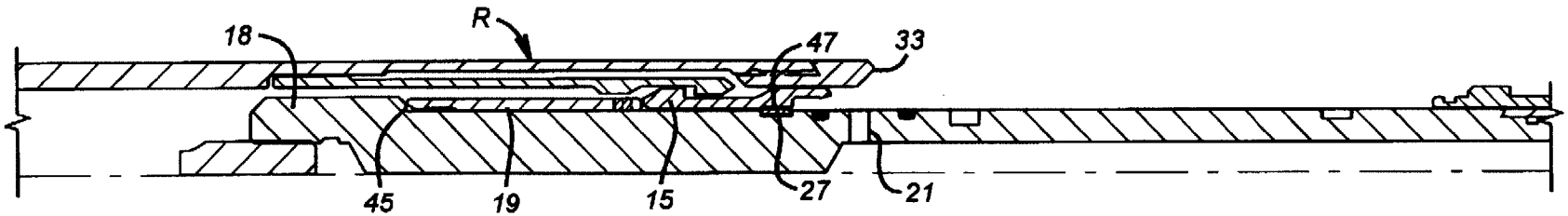
Figure 4A:
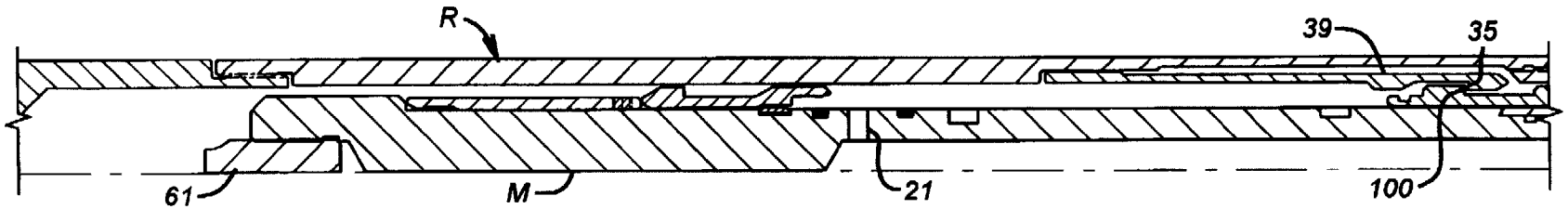

Above the equalizing sleeve 15 is equalizing cover 19. Equalizing cover 19 straddles port 21. Seals 23 and 25 effectively block port 21 in the run-in position shown in FIG. 1*a*. The position of the equalizing cover 19 is secured by a snap ring, or C-ring, or equivalent fastener 27. It is initially held by shear screw 129. It can be seen that the port 21 communicates to outside the tool around the setting tool S when the equalizing cover 19 is shifted, as illustrated in FIG. 3*a*. Once the cover 19 is shifted, the annulus pressure equalizes with the internal pressure in the bridge plug B designated by internal passage 29.

Figure 11:
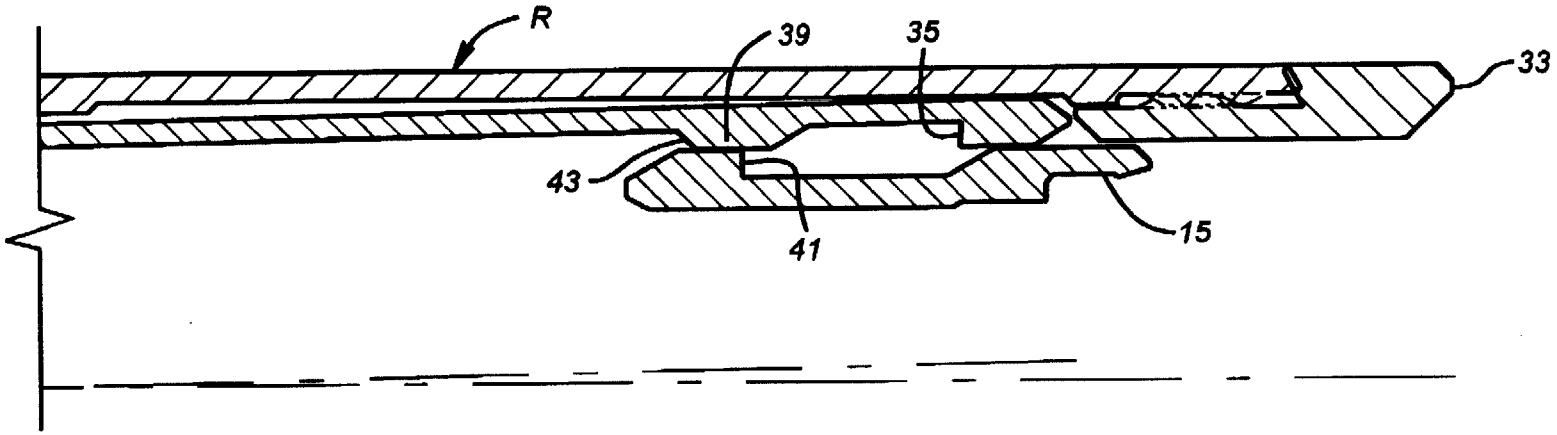
FIG. 11 is a partial sectional view showing the release tool passing over the equalizing sleeve.
Figure 12:
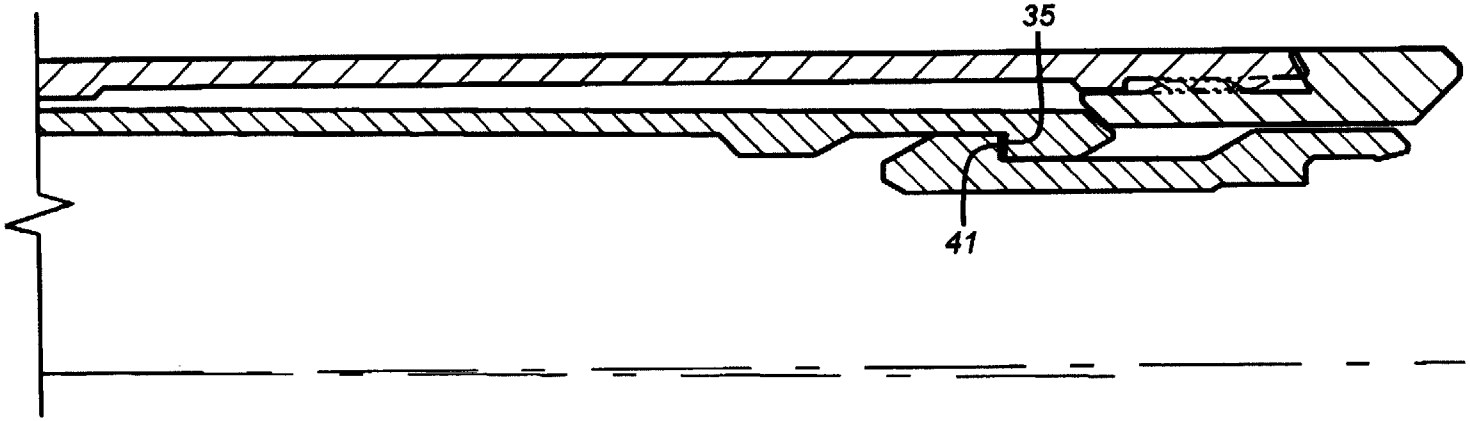
FIG. 12 is the view of FIG. 11 with the release tool engaging the equalizing sleeve after having passed over it.

Those skilled in the art will appreciate that after the bridge plug is set in a manner which will be described below, and a release of the bridge plug B is desired, an equalization procedure is advantageous before trying to release the sealing elements 58, 60 and 62 on the slips 84. To accomplish the equalization procedure, a known release tool R, as shown in FIG. 3*a*, is brought down over the equalizing sleeve 15, as well as the equalizing cover 19. The retrieving tool R eventually bottoms on shoulder 31 when its lower end 33 can advance no further. As shown in FIG. 11, the lower end 33 advances past the equalizing sleeve 15 without shoulder 35 dropping into recess 37 of equalizing sleeve 15. It is only after lower end 33 bottoms on shoulder 31 and the surface personnel become aware that the tubing can no longer advance that surface personnel begin to pull up on the tubing so that the shoulder 35 on fingers 39 in the retrieving tool R can enter the recess 37 and catch shoulder 41, as shown in FIG. 12. It should be noted from looking at FIG. 11 that on the trip down to get lower end 33 to bottom on shoulder 31, that projection 43 on fingers 39 keep the shoulder 35 from dropping into recess 37. However, on the way up, shoulder 35 falls right into recess 37 when projection 43 passes over shoulder 41. These motions are illustrated in FIGS. 11 and 12. Shoulder 35 can't fall in front of shoulder 100 until equalizing sleeve 15 is moved uphole. Then, after setting down and picking up shoulder 35, can first catch shoulder 100 to shift sleeve 24.

Figure 2A:
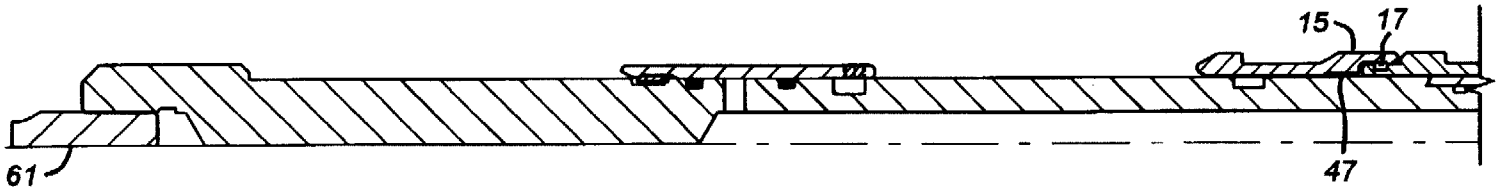

As a result, when it ultimately comes time to equalize, as shown in FIG. 3, the retrieving tool R is pulled upwardly with shoulders 35 and 41 in engagement to eventually contact the equalizing cover 19 with sleeve 15 and force cover 19 upwardly to expose the port 21. As the cover 19 is being moved upwardly against the force that retains it created by fastener 27, the tubing string, which supports the retrieving tool R, is firmly latched onto the structure of the bridge plug B due to the interengagement of shoulders 35 and 41. This is significant in that movement of the cover 19 can result in a large release of energy through port 21. Prior designs that have depended on set-down weight to keep the tubing string in contact with the packer or a bridge plug during an equalization process, have suffered from the drawback that large velocities stemming from the equalization procedure have dislodged the tubing string or release tool from the packer or bridge plug B. If coiled tubing is in use, for example, dislodging of the release tool from the plug could force the coiled tubing to kink in the wellbore requiring that the coiled tubing be fished out or milled out if it becomes stuck. In situations where there is a dramatic pressure difference across the packer or bridge plug B, the removal of the cover 19 to expose port 21 could result in a significant upward force on the retrieving tool, as well as the tubing string which supports it. In the design as shown, even if this occurs, the retrieving tool R and the tubing string (not shown) remains in firm contact with the cover 19 through the interengagement of shoulders 35 and 41 on the retrieving tool R and equalizing sleeve 15, respectively. The uphole force on the string that keeps shoulders 35 and 41 together as equalization occurs and prevents inadvertent disconnection of the retrieving tool R. It should be noted that the upper travel limit of the equalizing sleeve and the cover 19 is illustrated in FIG. 3*a* to occur when the cover 19 is stopped from further upward movement by a shoulder 45 on body segment 18. As seen by comparing FIGS. 3*a* and 4*a*, the retrieving tool R after first bottoming on shoulder 31 and then lifting the sleeve 15, along with cover 19, must have its direction reversed downwardly in order to allow shoulder 35 of fingers 39 to engage shoulder 100 of sleeve 24. As also seen by comparing FIGS. 2*a* and 3*a*, the tab 17 on equalizing sleeve 15 is broken off equalizing sleeve 15 when the shoulders 35 on fingers 39 grab shoulder 41 on equalizing sleeve 15 and pull it upwardly. Furthermore, as shown in FIG. 2*a*, the equalizing sleeve 15 has a recess 47 at its lower end. The snap ring or other fastener 27 ultimately expands into recess 47 as shown in FIG. 3*a* to keep the equalizing sleeve 15 from dropping back down after the releasing tool R is brought down from the position shown in FIG. 3*a* to the position shown in FIG. 4*a*. As a result, port 21 remains open as the bridge plug B is released in the manner described below.

Another feature of the bridge plug B of the present invention is a boost feature which increases the sealing pressure on the sealing elements 58, 60 and 62 if, after setting, the well pressure below the bridge plug B increases as compared to the pressure above the bridge plug B with the elements 58, 60 and 62 in the set position, such as, for example, shown in FIG. 2.

A chamber 49 is formed between ends 76 and 78. Seals 51, 53 and 55 seal off chamber 49 with the only access into chamber 49 available between sleeve 64 and body 14. Those skilled in the art will note that there is no seal between sleeve 64 and body segment 14 so that access into chamber 49 from above sealing elements 58, 60 and 62 is provided. Accordingly, sleeve 64 serves as a piston in that the annular space around the bridge plug B, but below the sealing elements 58, 60 and 62, has access to the sleeve 64 through port or ports 57. Ports 57 are schematically illustrated offset from shear pin or pin 70, but in the preferred embodiment they are in alignment such that seal 51 does not have to move across port 57 to obtain the position shown in FIG. 2*c*. Accordingly, a chamber 59, which is scaled by sealing element 62, as well as O-ring seal 51, is created and pressure therein acts in a downward direction on sleeve 64. Thus, when the pressure downhole of sealing elements 58, 60 and 62 increases, the slips 84 hold the bridge plug B in position while the unbalanced force on sleeve 64 tends to move or force it downwardly against uphole pressure seen in chamber 49. With the slips 84 in engagement, the greater force downhole from chamber 59 on sleeve 64 exceeds the uphole force on sleeve 64 from chamber 49 with a result that the assembly of Sealing elements 58, 60 and 62 is further compressed as ring 56 is brought down in conjunction with the downward movement of sleeve 64.

Figure 2D:
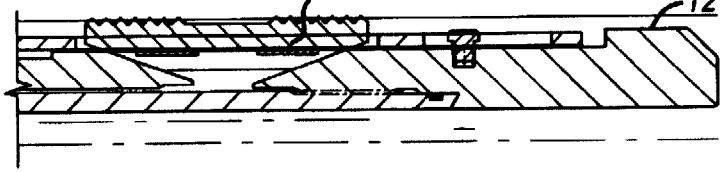
Figure 3D:
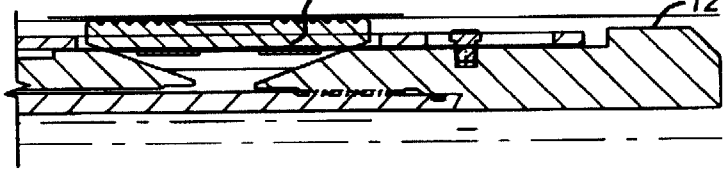
Figure 4D:
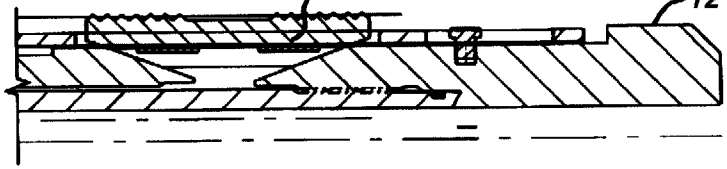
Figure 5A:
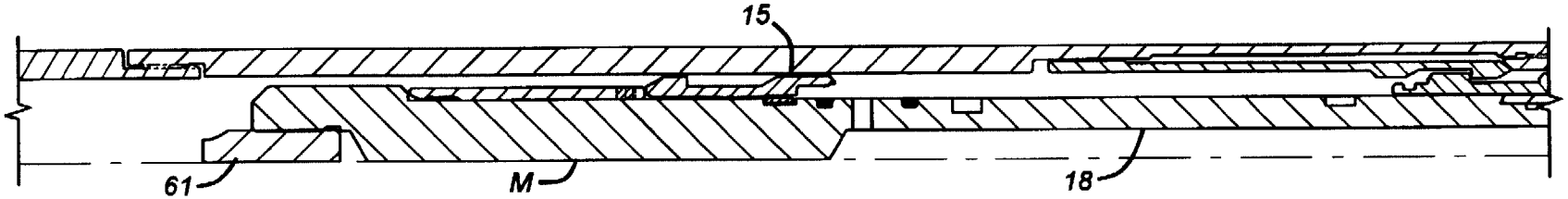
Figure 6A:
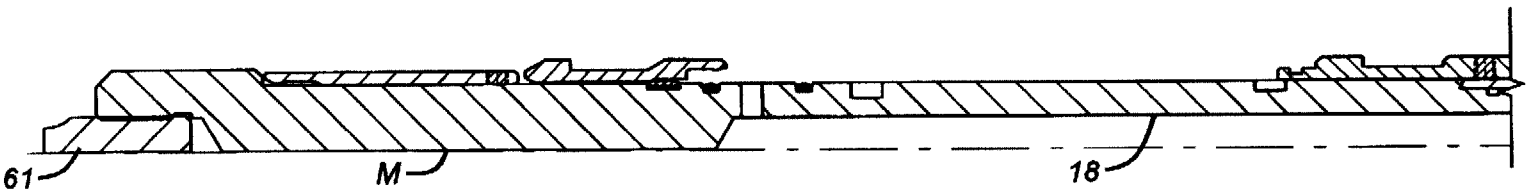
Figure 10:
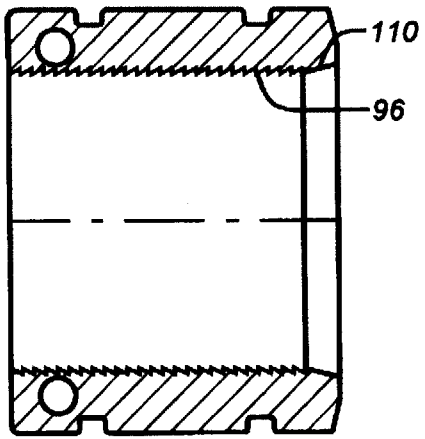
FIG. 10 is a section view of the one of the locking dogs.

The principal components of the bridge plug or packer B having been described, the setting operation will now be discussed. As previously stated, known setting tools are used and secured to body 18. A setting tool S of known design will have a movable setting sleeve which can be actuated to create relative movement between such a setting sleeve S shown in FIG. 1*a*. The setting sleeve S bears on actuating sleeve 24 to push it down while holding stationary body 18. This type of a setting tool can be run on wireline, coiled tubing, or rigid tubing as the situation warrants. While the setting sleeve S is bearing down, the bottom sub 12 (see FIG. 2*d*) is being held stationary because it is literally connected through a series of members to the body 18, which is being held by the setting tool S. Initially, after breaking shear pin 30, the force applied by the setting sleeve S is transmitted through actuation sleeve 24, sleeve 36, ring 42, release ring 50, ring 54, sleeve 64, ring 68, and finally to cone 72. The cone 72 moves downwardly, as shown by comparing FIGS. 1*c*–1*d* to FIGS. 2*c*–2*d*, thus camming the slips 84 outwardly along bottom sub 12 and cone 72. Eventually, the slips reach contact with the tubing or casing C, as shown in FIG. 2*d*. Further application of force using the setting sleeve S results in further downhole movement of sleeve 24. This in turn results in breaking of shear pin 70 (see FIG. 3*c*). Since the slips 84 are already set, thus fixating the cone 72 and the ring 68, the sealing elements 58, 60 and 62 are then squeezed ultimately against the ring 68 by ring 56 (see FIG. 3*c*). As this movement is occurring, the lock mechanism L, which features a series of dogs 90, each of which rides in a respective window 92 (see FIG. 8), rides down teeth 94 (see FIG. 3*b*). Each of the dogs 90 have teeth 96 (see FIG. 10), which are oriented with respect to teeth 94 to allow the dogs 90 to move downwardly, as shown by comparing FIGS. 2*b*–3*b*. A band spring or springs 98 fits around all the dogs 90 to put a bias radially inwardly to urge the teeth 96 toward the teeth 94. However, in response to a force applied by the setting sleeve S, the teeth 96 skip over the teeth 94 until the sealing elements 58, 60 and 62 are fully compressed. At that point, upward movement of the dogs 90 is prevented as the teeth 96 bite into the teeth 94 which, due to the orientation of the teeth patterns, prevents the dogs 90 from jumping out of contact with the body 14 on which teeth 94 can be found. The movements through FIG. 3 have now been described and the bridge plug or packer B is now fully set. The known setting tool automatically releases in a known manner, such as by braking flangible member 61, and the bridge plug or a packer B is now fully serviceable.

Figure 4B:
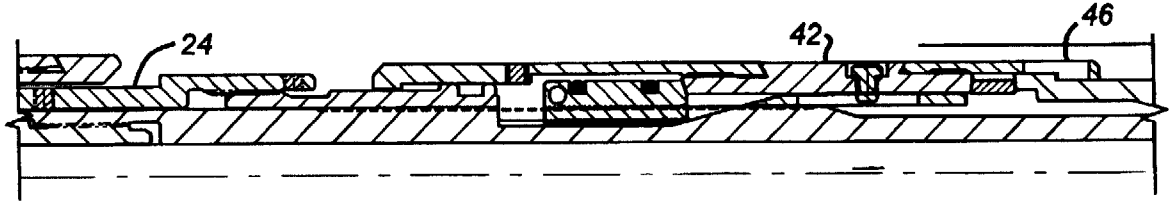

When it comes time to release the bridge plug or packer B, a known release tool R is inserted into the wellbore. The equalizing procedure as described previously now occurs. After equalizing, shoulder 35 is still engaged to the shoulder 100 (see FIG. 4*a*) while slips 84 hold packer B in a fixed position. The release tool R then exerts an upward force on actuating sleeve 24 through the shoulder 100. The shear pin 40 is then broken, as shown in FIG. 4*b*. Further upward movement of actuating sleeve 24 ultimately undermines the support for release ring 50 when the lower end 52 is pulled up and out from under the release ring 50. At this time, teeth 94 and 96 are still engaged, while window 88 moves with respect to dogs 90. This can be seen by comparing FIG. 4*b*to 5*b*. When the release ring 50 is allowed to relax and, therefore, jump out from between ring 54 and ring 42, it creates a gap therebetween which allows the retained compressed force in the sealing elements 58, 60, and 62 to be relieved, as rings 54 and 56 move up with respect to release mandrel 28. This results in an upward movement of ring 54 to take up the space where the release ring 50 formerly occupied. Ultimately, ring 54 moves upwardly until it engages ring 42, as shown in FIG. 5*b*. At this time, the release ring 50 has flexed radially inwardly and is in alignment with the release mandrel 28. This allows ring 54 to move over and on top of the release ring 50 as it reaches its full length of travel and impacts ring 42.

Figure 5C:
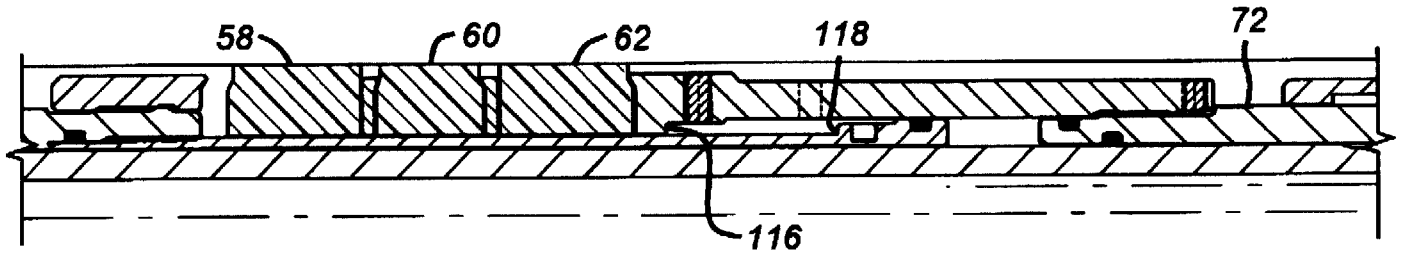

Referring to FIG. 5*c*, the movement of ring 54 is illustrated shortly before the elements 58, 60 and 62 actually relax (note the gap between ring 56 and element 58). Ultimately, in FIGS. 6*b*–6*c*, the elements 58, 60 and 62 are fully relaxed. Those skilled in the art will appreciate that these events occur very quickly.

Figure 7A:
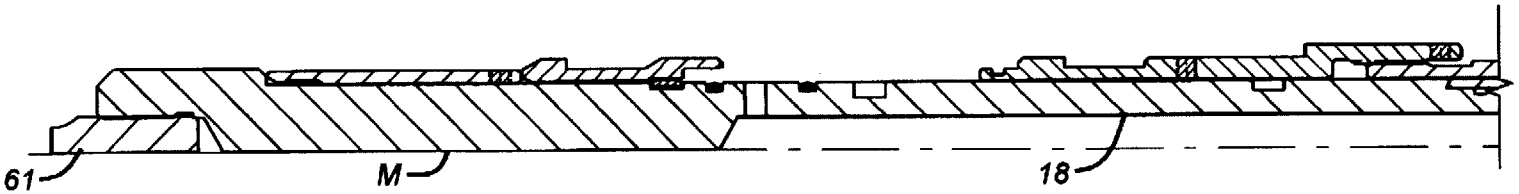
Figure 6B:
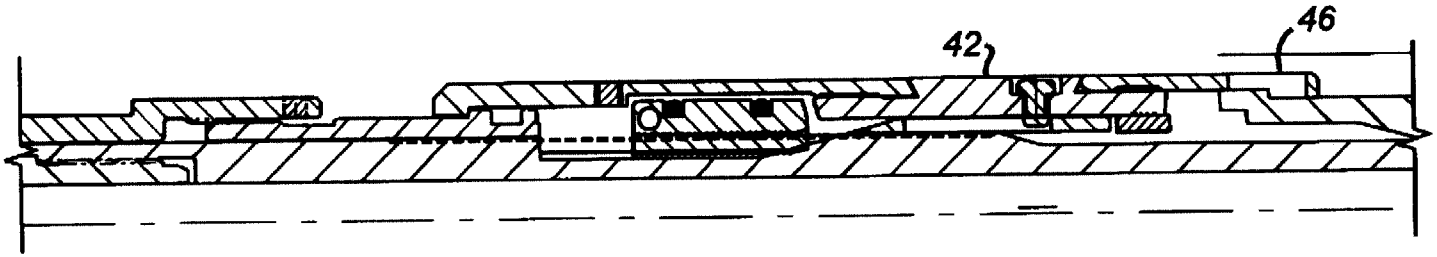
Figure 7B:
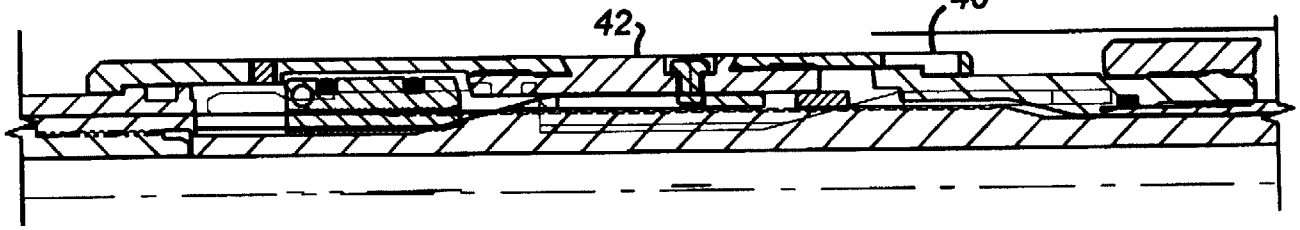
Figure 6C:
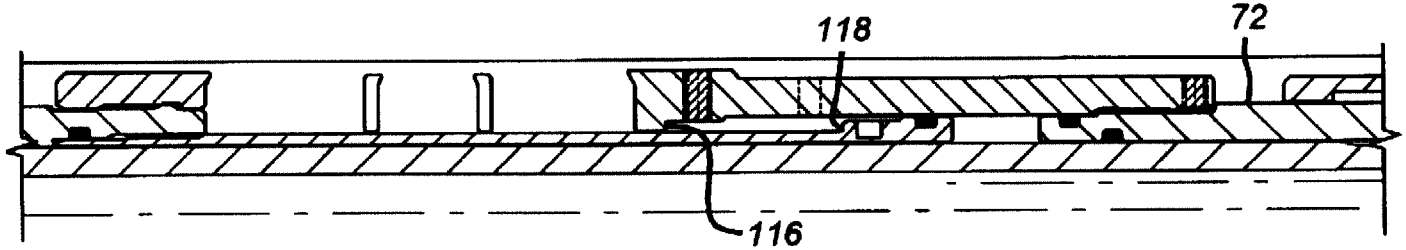
Figure 7C:
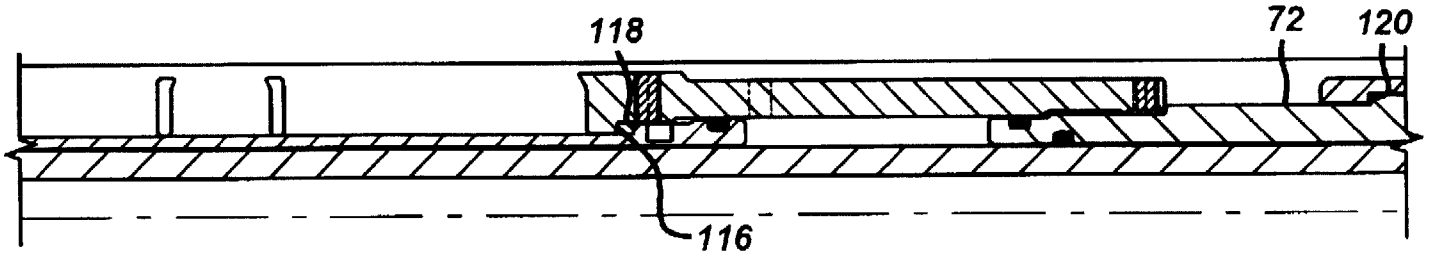
Figure 5D:
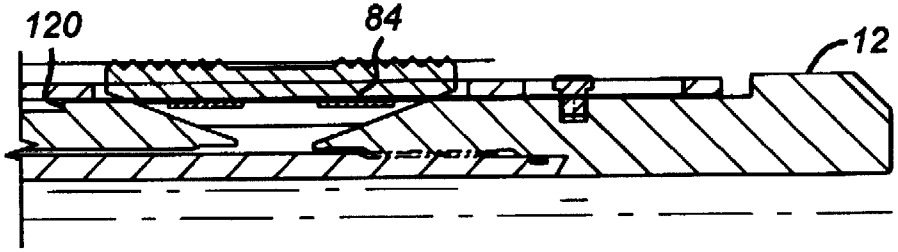
Figure 6D:
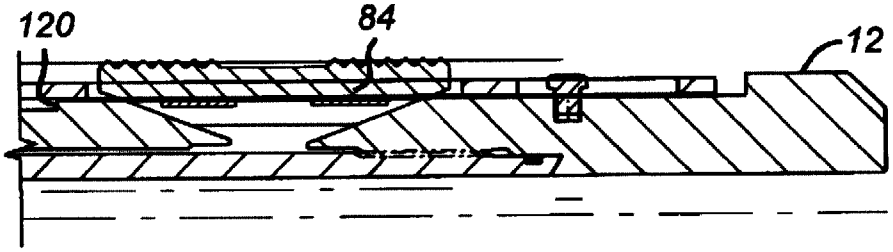
Figure 7D:
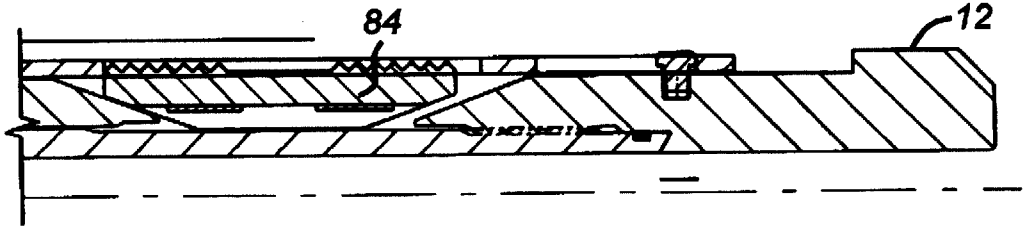
Figure 9:
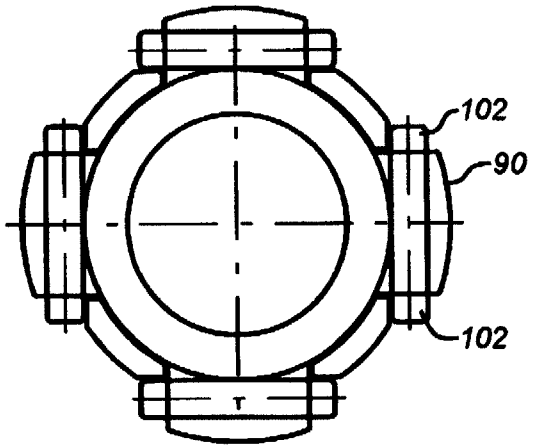
FIG. 9 is a sectional view through the locking dogs, illustrating the use of the pin which extends out of both ends which assists in the release sequence.

Referring now to FIGS. 5 and 6*b*, the unlocking of the locking mechanism L which includes the dogs 90 will now be described. As shown in FIG. 9, each of the dogs 90 optionally has a pin 102 which extends out on either end of the dog 90. The pin 102 is eventually engaged by opposed ledges 104 and 106 (see FIG. 8*a*). Window 92 has a sloping ramp 108 at its lower end. In the preferred embodiment, ramp 108 is at about 15°. Ramp 108 catches taper 110 on dogs 90 (see FIG. 10). Ledges 104 and 106 begin with upwardly sloping tapers 112 and 114, respectively (i.e., away from the longitudinal axis on approach to ledges 104 and 106) (see FIG. 8*a*). Thus, upon uphole movement of sleeve 24 (i.e., away from elements 58, 60, and 62), the release mandrel 28 is also pulled up. After breaking the shear pin 40 and liberating the release ring 50, the sealing elements 58, 60 and 62 are able to relax completely. Further pulling up on sleeve 24 and in turn release mandrel 28 allows the ramp 108 to engage the taper 110 to begin initial disengagement of teeth 94 and 96. Upon further movement of mandrel 28, the pins 102 (if used) catch on tapers 112 and 114 and ultimately ride along ledges 115 and 117. The combined movement resulting from contact between the ramp 108 and the dogs 90 at taper 110, followed by the contact of pins 102 riding on ramps 112 and 114, moves the dogs 90 radially outwardly to disengage the teeth 96 from the teeth 94. Shoulder 108 can be used exclusively to separate teeth 94 and 96 without use of pins 102 or ramps 112 and 114. It should be noted that this disengagement occurs only after the sealing elements 58, 60 and 62 have been relaxed. Further upward pulling on the shoulder 100 (as shown in FIG. 7*a*) ultimately, through the contact of shoulders 116 and 118, pulls up ring 68 which takes with it cone 72 out from under slips 84, leaving them free to retract away from the casing or tubing C, and the entire assembly can be removed from the wellbore. On the way out, a shoulder 120 on cone 72 retains the slip retainer 80 for removal from the wellbore.

The entire operation of setting and releasing the bridge plug or packer B of the present invention has now been described. It can be seen that a simple mechanism has been provided which can transmit forces to accomplish setting such as through a release ring 50. Thereafter, the release ring 50, which had previously transmitted a force, moves out of the way to relieve a stored compressive force on the sealing elements 58, 60 and 62. This relief occurs prior to any attempt to disengage in the locking mechanism L, which in this preferred embodiment consists of the assembly of the locking dogs 90 with the interengaging teeth 94 and 96. Finally, only when the sealing elements have all of the compressive force on them relieved is there an attempt to cam the locking dogs 90 out of engagement. This is significant because in prior designs, efforts to cam the locking elements involving the use of teeth while under a stress undermined the mechanical integrity of the engagement of such teeth and subjected such teeth to chipping or breaking during the release. Alternatively, all other approaches to the problem have involved totally disjointed pressure- or stress-relief mechanisms that have generally been located below the packer or bridge plug. In the apparatus of the present invention, the lock mechanism is simple and is operable in a smooth motion with a stress-relief mechanism. The components are arranged in such a way to ensure the relief of built-up stress acting on the sealing elements 58, 60 and 62 before any attempt is made to disengage the locking mechanism L which includes the dogs 90. The entire assembly is situated above the sealing elements 58, 60 and 62. It should be noted that while the use of a release ring 50 has been indicated, other mechanisms to relieve the stress on the scaling elements 58, 60 and 62 are within the purview of the invention.

The significance of the invention is further heightened by the compactness of the arrangement of the components which allows for relatively short assembly for the packer or bridge plug. Those of ordinary skill in the art will appreciate that the lock and release assembly as described can be used with other downhole tools, such as liner hangers and the like.

One of the advantages of the invention is that in the setting procedure, the release ring 50 functions to transmit setting forces, while in the release mode it moves out of the way to enable a relative movement or lost motion feature to occur to relieve the accumulated stress on the sealing elements 58–62 to facilitate the subsequent automatic disengagement of the teeth 94 and 96 upon further upward movement of the sleeve 24.

Optionally, in an alternative embodiment, the benefits of the compact design and top access can also be obtained without the stress-relief feature such as ring 50 or equivalent stress-relief mechanisms. The life of the locking mechanism L may not be as long as the preferred embodiment, but other stated advantages of compactness and simplicity can be achieved.

It can also be appreciated that the equalizing feature disclosed offers advantages over prior techniques of equalization for packers and bridge plugs. In the technique that is disclosed, the tubing string is lowered until it can advance no further followed by an upward pull. If resistance is met and indicators at the surface show equalization has occurred, the surface personnel know that the tubing string has grabbed the equalizing sleeve 15 and that full equalization has occurred. The sleeve 24 cannot be grabbed at this time because the presence of sleeve 15 prevents such an engagement. The risk of unintentional release of the tubing string or releasing tool R during the equalization procedure is eliminated. Surface personnel must go down with the tubing until it can advance no further and then consciously reverse direction in order to get a grip on only the equalizing sleeve 15. When getting the appropriate signals that equalization has occurred, direction is again reversed in order to drop down and pickup the release sleeve 24 at shoulder 100 to initiate the release by an upward force. The advantages offered are that with these directional reverses to accomplish these discrete tasks, it is assured that the equalization procedure is knowingly entered into and fully completed before any of the releasing steps are initiated. This is to be contrasted with prior designs which involve a discrete unidirectional movement to initiate equalization and release. Even in designs that equalize by setting down weight there was a risk of a disconnection in the face of a vigorous pressure release, particularly in J-slot-type prior designs. Designs that are equalized by pulling up, followed by release by setting down, could still release prematurely if stretch in the wireline or coiled tubing or inadvertent set down occurred before equalization had concluded. In some wells, equalization can take quite a bit of time. Accordingly, with some prior designs, the release procedure was initiated before the equalization procedure had fully concluded. This created the undesirable result of the packer or plug B becoming a projectile within the well as the differential pressure that still existed due to incomplete equalization accelerated the bridge plug or packer B when the slips were released prior to complete equalization of pressure. In the current design, the equalization sleeve is retained by an upward force and is further prevented from coming back down once it has been pulled up by the retainer 27. It is only when surface personnel have determined that equalization has concluded, followed by a discrete set-down force with a subsequent pickup force, is the release procedure concluded. With the retention of the equalizing sleeve 15 by the release tool R inadvertent or unexpected releases from the packer or plug B during equalization which could cause kinking or jamming of the tubing requiring a milling or fishing operation are eliminated.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for securing the setting of and releasing of a downhole tool with respect to tubing or casing therein, said apparatus comprising:

a body;

an anchoring assembly mounted to said body;

a sealing assembly mounted to said body;

at least a first movable member supported by said body for urging said anchoring assembly from a retracted position to an extended position in contact with the tubing or casing;

at least a second movable member supported by said body for urging said sealing assembly from a retracted position to an extended position in contact in the tubing or casing;

a lock assembly located on said body, uphole from said sealing assembly and said anchoring assembly, to secure said sealing and anchoring assemblies in their said extended positions;

a release assembly accessible on said body, uphole of said sealing and anchoring assembly, to selectively defeat said lock assembly;

a stress-relief assembly on said body to selectively remove stress applied to said lock assembly by said sealing assembly in said extended position; and whereupon said release assembly can defeat said lock assembly after applied stress thereon has been substantially relieved.

2. The apparatus of claim 1, wherein:

said stress-relief assembly is movable between a first position, where it is capable of transmitting a force to said second movable member for urging said sealing assembly toward its said extended position, to a second position in which said second movable member can move with respect to said body to allow said sealing assembly to return toward its said retracted position, with said lock assembly secured.

3. The apparatus of claim 2, wherein said lock assembly further comprises:

a movable sleeve formed having at least one window thereon and at least one dog in said window, said dog movable with respect to said body in one direction and locking against opposed movement;

whereupon actuation of said sealing assembly toward its said extended position, said movable sleeve moves said dog in said window with respect to said body and then said dog locks against said body to retain said extended position of said sealing assembly.

4. The apparatus of claim 3, wherein:

said movable sleeve retains said stress-relief assembly in said first position as said sealing assembly is urged toward its said extended position.

5. The apparatus of claim 4, wherein:

movement of said movable sleeve with respect to said body removes support for said stress-relief assembly which allows said second movable member to move with respect to said stress-relief assembly to allow said sealing assembly to move toward its said retracted position with said dog secured to said body.

6. The apparatus of claim 5, wherein:

further movement of said movable sleeve beyond undermining support for said stress-relief assembly brings said window in contact with said dog for camming said dog into disengagement from said body.

7. The apparatus of claim 6, wherein said release assembly further comprises:

a taper formed at one end of said window which engages a mating taper on said dog to initialize the camming of said dog away from said body.

8. The apparatus of claim 7, wherein:

said dog is formed having at least one extending member disposed adjacent an end thereof opposite said mating taper; and said window is formed having at least one sloping surface which engages said extending member after said dog has already been engaged by said taper at one end of said window.

9. The apparatus of claim 8, wherein:

said extending member comprises a rod which extends laterally on opposed sides;

said window is formed having opposed sloping surfaces to engage opposed ends of said rod; and said opposed sloping surfaces each abut an extension surface that runs substantially parallel to the longitudinal axis of said body, whereupon said dog is retained in a cammed position with said rod riding on said extension surfaces as said movable sleeve is advanced.

10. The apparatus of claim 9, wherein:

said dog is formed having a plurality of first teeth, said body is formed having a plurality of second teeth, said first and second teeth arranged in a manner so as to allow said first teeth on said dog to ratchet over said second teeth to secure said sealing assembly in said extended position, said first and second teeth locking against movement opposed to said ratcheting movement until said window cams said dog to separate said teeth.

11. The apparatus of claim 10, wherein:

said dog is spring-loaded to resiliently force said first teeth toward said second teeth until such time as said window cams said dog to overcome said spring on said dog.

12. The apparatus of claim 11, wherein:

said movable sleeve operably connected to said first movable member to undermine said anchoring assembly to allow said anchoring assembly to move toward its said retracted position for removal of the tool from the wellbore.

13. The apparatus of claim 12, wherein:

said movable sleeve after camming said dog retains said second movable member in said retracted position to facilitate removal of the tool from the wellbore.

14. The apparatus of claim 13, wherein:

said movable sleeve after camming said dog retains said first movable member in said retracted position to facilitate removal of the tool from the wellbore.

15. The apparatus of claim 6, further comprising:

said second movable member exposed to pressures downhole below said sealing assembly such that increases in pressure in the wellbore below said sealing assembly with said sealing assembly in said extended position creates an unbalanced force on said second movable member toward said anchoring assembly to increase the applied force on said sealing assembly in its said extended position.

16. The apparatus of claim 3, wherein:

said stress-relief assembly further comprises a split ring initially assembled over said movable sleeve with a built-in bias radially inwardly toward the longitudinal axis of said body.

17. The apparatus of claim 16, wherein:

said split ring comprises at least one notch on its periphery to regulate the force at which it contracts when becoming unsupported, while at the same time maintaining sufficient longitudinal strength to transmit a force to said second movable member to urge said sealing assembly toward its said second extended position.

18. A method of releasing a downhole tool having slips and a sealing element, comprising:

locating a locking mechanism above said sealing element;

unloading said sealing element from a set to a relaxed position by permitting relative component movement initiated from above said sealing element without unlocking said locking mechanism; and releasing said locking mechanism when there is little or no applied stress exerted on it from said sealing element.

19. The method of claim 18, further comprising:

using a movable sleeve with at least one dog in at least one window as said locking mechanism;

using said sleeve to support a release member;

applying a force through said release member to set said sealing element;

removing support for said release member by moving said movable sleeve;

allowing said release member to move; and undermining a compressive force on said sealing element and said dog by said moving of said release member.

20. The method of claim 19, further comprising:

using engaging teeth to secure said dog for holding said compressive force on said sealing element; and using a sloping surface in said window to cam apart said engaging teeth only after said flexing of a split ring which functions as said release member.

21. An apparatus for securing the setting of and releasing of a downhole tool with respect to tubing or casing therein, said apparatus comprising:

a body;

an anchoring assembly mounted to said body;

a sealing assembly mounted to said body;

at least a first movable member supported by said body for urging said anchoring assembly from a retracted position to an extended position in contact with the tubing or casing;

at least a second movable member supported by said body for urging said sealing assembly from a retracted position to an extended position in contact in the tubing or casing;

a lock assembly located on said body, up hole from said sealing assembly and said anchoring assembly, to secure said sealing and anchoring assemblies in their said extended positions;

a release assembly accessible on said body, up hole of said sealing and anchoring assembly, to selectively defeat said lock assembly; and said second movable member exposed to pressures downhole below said sealing assembly such that increases in pressure in the wellbore below said sealing assembly with said sealing assembly in said extended position creates an unbalanced force on said second movable member toward said anchoring assembly to increase the applied force on said sealing assembly in its said extended position.

22. A method of retrieving a downhole tool secured in a wellbore with a pressure differential across it, comprising:

running in a release tool;

engaging the downhole tool with the release tool;

moving the release tool in a first direction to equalize pressure;

having to make at least one movement in a second direction opposed to said first direction before release of the tool is possible by further movement in said first direction;

providing an equalizing sleeve and a release sleeve on the tool; and operating the equalizing sleeve independently of said release sleeve to equalize the tool before releasing it.

23. The method of claim 22, further comprising:

configuring the release tool to preferentially grab, when moving in said first direction, said equalizing sleeve first after initial contact with the downhole tool.

24. The method of claim 23, further comprising:

allowing release from said equalizing sleeve by reversing movement of said release tool to move it in said second direction.

25. The method of claim 24, further comprising:

retaining said equalizing sleeve to the downhole tool in a position where it retains its position to which it was moved to begin said equalizing.

26. A method of claim 25, further comprising:

grabbing said release sleeve only after disengaging from said already moved equalizing sleeve.

27. The method of claim 23, further comprising:

using the initial proximity of said equalizing and release sleeves to preclude said release tool from engaging said release sleeve first.

28. The method of claim 27, further comprising:

allowing the release tool to move into engagement with the release sleeve as a result of earlier displacement of said equalizing sleeve away from said release sleeve.

29. A method of retrieving a downhole tool secured in a wellbore with a pressure differential across it, comprising:

running in a release tool;

engaging the downhole tool with the release tool;

moving the release tool in a first direction to equalize pressure;

having to make at least one movement in a second direction opposed to said first direction before release of the tool is possible by further movement in said first direction;

seeing initial resistance to movement of said release tool in said first direction as a signal that equalizing will begin if force in said first direction is further increased;

actuating equalization with the release tool in tension and retaining the downhole tool;

setting down weight on the release tool after equalizing;

picking up said release tool after setting down to actuate subsequent release of the downhole tool; and being able to access a release sleeve to release the tool only after moving an equalizing sleeve to achieve equalization.

30. A method of retrieving a downhole tool secured in a wellbore with a pressure differential across it comprising:

running in a release tool;

engaging the downhole tool with the release tool;

moving the release tool in a first direction to equalize pressure having to make at least one movement in a second direction opposed to said first direction before lease of the tool is possible by further movement in said first direction;

using a release sleeve to release the downhole tool;

providing slips and a sealing element on the downhole tool;

locating a locking mechanism above said sealing element;

unloading said sealing element from a set to a relaxed position by permitting relative component movement initiated from above said sealing element through use of said release sleeve without unlocking said locking mechanism; and releasing said locking mechanism when there is little or no applied stress exerted on it from said sealing element.

31. The method of claim 30, further comprising:

using a movable sleeve with at least one dog in at least one window as said locking mechanism;

using said sleeve to support a release member;

applying a force through said release member to set said sealing element;

removing support for said release member by moving said movable sleeve;

allowing said release member to move; and undermining a compressive force on said sealing element and said dog by said moving of said release member.

32. The method of claim 31, further comprising:

using engaging teeth to secure said dog for holding said compressive force on said sealing element; and using a sloping surface in said window to cam apart said engaging teeth only after said flexing of a split ring which functions as said release member.

* * * * *